US006209814B1

(12) United States Patent
Helton

(10) Patent No.: US 6,209,814 B1
(45) Date of Patent: Apr. 3, 2001

(54) MULTI-ROLL SEGMENT PACKAGE FOR PLASTIC TAPE

(75) Inventor: Kennith H. Helton, Gainesville, GA (US)

(73) Assignee: Tricon Conversion, LLC, Gainesville, GA (US)

( * ) Notice: Subject to any disclaimer, the term of this patent is extended or adjusted under 35 U.S.C. 154(b) by 0 days.

(21) Appl. No.: 09/370,677

(22) Filed: Aug. 9, 1999

(51) Int. Cl.[7] ..... B65H 18/28
(52) U.S. Cl. ..... 242/160.2; 242/531
(58) Field of Search ..... 242/160.2, 531, 242/531.1, 167, DIG. 2; 206/393, 391, 394

(56) References Cited

U.S. PATENT DOCUMENTS

| | | | | |
|---|---|---|---|---|
| 2,432,270 | | 12/1947 | Asbill, Jr. . | |
| 2,604,275 | | 7/1952 | Hull | 242/118 |
| 2,650,703 | | 9/1953 | Hagen . | |
| 2,912,102 | | 11/1959 | Scott . | |
| 3,025,015 | * | 3/1962 | Mix | 242/613 |
| 4,603,817 | | 8/1986 | O'Connor . | |
| 6,007,016 | * | 12/1999 | Helton | 242/531.1 |

* cited by examiner

*Primary Examiner*—John M. Jillions
(74) *Attorney, Agent, or Firm*—Kenneth S. Watkins, Jr.

(57) ABSTRACT

A multi-roll segment package (101) for plastic tape comprises a plurality of roll segments made up of concentrically disposed spiral winding groups (119) separated and defined by helical winding portions of tape (121) connecting the spiral winding groups on adjacent roll segments. The spiral winding groups of the end roll segments (111A), (111B) comprise at least 2.5 times the number of windings as the center roll segments (115A), (115B), (115C). The roll package features high wind density and good resistance from telescoping.

13 Claims, 1 Drawing Sheet

117A
119
121
121
117B
119

SEE FIG. 1A
111A
113B
111B
121
109
121
115C
115B
115A
113A
121
101
105
103
107

MULTI-ROLL SEGMENT PACKAGE FOR PLASTIC TAPE

BACKGROUND OF THE INVENTION

The present invention relates to winding and, more particularly, to winding plastic tape on cores.

Plastic tape has become commonplace in a number of products including electrical products such as wire, cable, conduit, transformers and other electrical components, as well as in packaging. The use of plastic tape as ties in plastic garbage and storage bags has grown significantly. Manufacturers utilize plastic tape in the form of rolls in automated machinery to produce a wide range of these products.

Rolls of plastic tape are normally wound on cores to aid in winding and provide improved stability of the roll. They are sometimes wound as a single "pancake" package which comprises a single roll having a width equal to the width of the plastic tape or film. Such a roll has the disadvantage of becoming unstable at large roll outer diameters, especially if the tape is narrow. The single roll package also limits the length of plastic tape, requiring frequent stopping of the machinery for roll changes.

Another winding method for roll packages utilizes a helical winding method, similar to winding a reel of line or string. This method produces a roll package with a width greater than the tape width and provides additional capacity of the roll package as compared to the "pancake" roll package. This winding method suffers the disadvantage of instability, especially near the roll package ends. Use of spools with end discs improves the stability, but increases the complexity, cost and weight of the package.

U.S. Pat. No. 4,603,817 discloses a tape package comprising a winding method which incorporates a plurality of axially spaced wind positions. The wind positions are made up of a plurality of separate spiral windings of at least one turn. Helical windings connect spiral windings to adjacent positions. The spiral winding groups of the end positions have twice the windings of intermediate positions. Although this method has some advantages over other winding methods, roll density is reduced due to frequent helical winding transitions or steps, and end stability still limits wind diameter.

OBJECTS AND SUMMARY OF THE INVENTION

Therefore an object of the present invention is to provide a roll package for plastic tape comprising multiple roll segments with reduced transition steps on the outer roll segments, especially the end roll segments.

A further object of the present invention is to provide a roll package having a high wrapping density, increasing the length of tape in a given package outer diameter.

A further object of the present invention is to provide a roll package which may be wrapped to larger roll diameters, increasing the capacity of the roll package.

A further object of the present invention is to provide a roll package with improved mechanical stability, reducing the reject rate of roll packages due to damage.

Surprisingly, it has been found that the helical transition windings between the spiral winding groups in prior art roll packages de-stabilize the roll segments, especially the end segments. This is believed due to non-uniformities introduced in the tape resulting from the stresses on the tape as the winding is stepped or axially displaced to an adjacent roll segment. The non-uniformities also reduce the winding density of the roll segments.

The roll package of the present invention comprises a single length of plastic tape wrapped on a core in a plurality of roll segments. In the preferred embodiment, the tape is continuous between the beginning of the tape at the core to the end at the segment outer diameter of the last roll segment. The roll segments are the approximate width of the tape. Each roll segment is made up of a plurality of concentrically disposed spiral winding groups. The winding groups comprise a plurality of continuous and non-interrupted spiral tape windings. The spiral winding groups of a roll segment are connected to spiral winding groups on adjacent roll segments by helical windings produced as the winding process "steps" to the next roll segment as the roll package is built up.

The roll segments of the roll package include two end roll segments and a plurality of inner roll segments. The inner roll segments of the preferred embodiment comprises at least two intermediate roll segments positioned adjacent to the end roll segments and axially displaced towards the center of the roll package, and at least one center roll segment positioned adjacent to an intermediate roll segment and axially displaced towards the center of the roll package. The spiral winding groups of the end roll segments have more individual tape windings than the spiral winding groups of the intermediate roll segments. At least a portion of the spiral winding groups of the intermediate roll segments have more individual tape windings than the spiral winding groups of the center roll segment(s).

In one of the embodiments, the spiral winding groups of the end roll segments comprise at least twice the number of windings as the spiral winding groups of the intermediate roll segments. At least a portion of the spiral winding groups of the intermediate roll segments comprise at least twice the number of windings as the spiral winding groups of the center roll segment(s).

In a preferred embodiment, the spiral winding groups of the end roll segments comprise approximately three to four times the number of windings as a first portion of spiral winding groups of the intermediate roll segments. The spiral winding groups of the end roll segments comprise approximately eight times the number of windings as a second portion of spiral winding groups of the intermediate roll segments. The first portion of the spiral winding groups of the intermediate roll segments comprise at least twice the number of windings as the spiral winding groups of the center roll segment(s).

The roll package structure of the present invention results in the end roll segments having less than half the number of spiral winding groups (or roll segment visits) as compared to the spiral winding groups of the center roll segments. In the preferred embodiments, the number of spiral winding groups making up the end roll segments is less than one fourth, more preferably less than one sixth, and most preferably approximately one eigth of the number of spiral winding groups as the center roll segments. The reduced number of spiral winding groups of the end roll segments increases the winding density of the end roll segments and improves the stability of the end roll segments by reducing the number of helical winding transitions and the resulting non-uniformity of the tape windings.

In the preferred embodiments, the end spiral groups comprise at least 2.5 times the number of wrappings as the center spiral groups. In the more preferred embodiments, the end spiral groups comprise at least 3 times the number of wrappings as the center spiral groups. In the yet more preferred embodiments the end spiral groups comprise at least 4 times the number of wrappings as the center spiral groups, and in the still more preferred embodiments, the end spiral groups comprise at least 6 times the number of wrappings as the center spiral groups. In the most preferred embodiments, the end spiral groups comprise at least 8 times the number of wrappings as the center spiral groups.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

Figures 1, 1A:
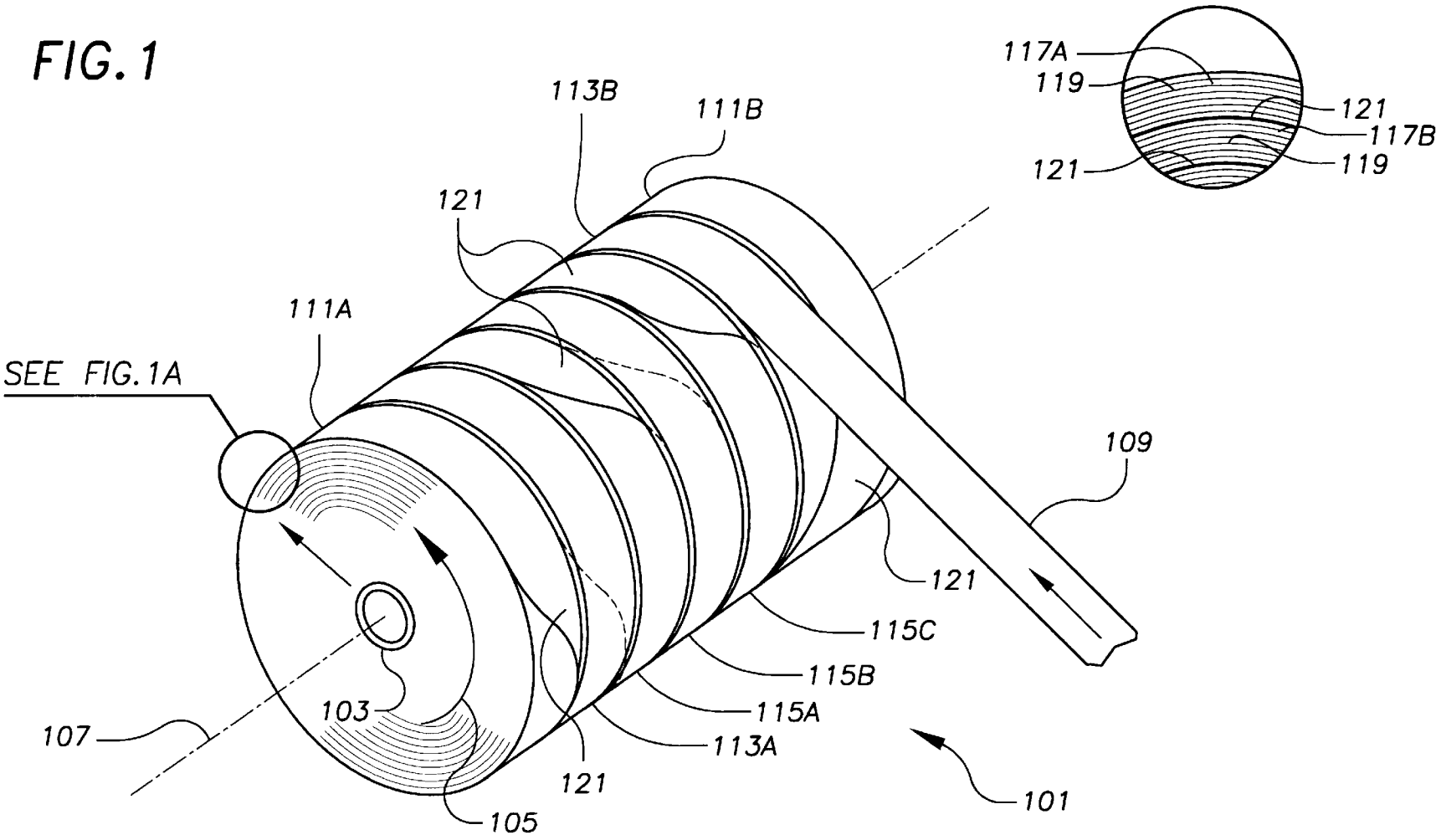
FIG. 1 is a perspective drawing of a multi-roll segment package of the present invention showing the package being wound on a core, several helical winding portions shown transitioning the winding from one roll segment axially to an adjacent roll segment.
FIG. 1A is a detail end view of several spiral winding groups on the end roll segment, the spiral winding groups consisting of several spiral wind layers and separated from adjacent, concentrically disposed spiral winding groups by helical winding portions.

The following is a description of the preferred embodiments of a multi-roll segment package of a single, continuous length tape and a method for making the package.

FIG. 1 is a perspective drawing of roll package 101. A winding machine such as that disclosed in related application Ser. No. 09/054,667, now U.S. Pat. No. 6,007,016, hereby included by reference, rotates core 103 in direction 105 about roll package axis 107. The machine feeds a continuous length of plastic tape 109 to build up roll package 101.

Roll package 101 comprises end roll segments 111A and 111B, intermediate roll segments 113A and 113B, and center segments 115A, 115B, and 115C. Each roll segment is made up of concentrically disposed spiral winding groups such as spiral winding groups 117A and 117B of detail FIG. 1A. Spiral winding groups 117A and 117B are made up of at least two continuous, uninterrupted tape windings or layers 119, spirally wound on each other. Helical winding portions such as portions 121 define the radial boundaries of spiral winding groups and connect a winding group on a roll segment to a spiral winding group of an adjacent roll segment. Helical portions 121 occur when tape 109 traverses or steps to an adjacent segment after winding a plurality of spiral windings on the group of the previous roll segment.

Experimentation and trial have demonstrated improved roll package stability by winding spiral winding groups on end roll segments 111A and 111B with a relatively large number of windings as compared to intermediate and center roll sections. The relatively larger number of windings on end roll segment spiral winding groups reduces the number of helical winding portions, increasing the wind density and stability of the end roll segment.

EXAMPLE 1

A 1" wide by 0.004" thick plastic tape was wrapped on a fiber core beginning on roll segment 111A position. A wrapping machine wrapped 32 layers of tape, forming the first spiral wind group of roll segment 111A. After a helical portion 121 wrap to roll segment position 113A, four layers were wrapped to form the first spiral wind group of roll segment 113A. The winding machine wrapped center roll segments 115A, 115B, and 115C in a similar fashion with four layers in each spiral wind group. Intermediate roll segment 113B position was wrapped with nine layers, the helical winding direction reversed towards end roll segment 111A, and the center roll segments wound with four windings in each spiral winding group. At the machine's second visit to intermediate roll segment 113A, nine layers were wrapped, followed by a reversal of the helical winding direction towards end roll segment 111B. The machine wrapped four windings on each group of center roll segments, and four on intermediate roll segment 113B, followed by 32 windings on end roll segment 111B.

The machine reversed helical wrap direction again towards end roll segment 111A, wrapping four windings on intermediate roll segment 113B and on each center roll segment, nine on intermediate roll segment 113A, reversed direction, wrapping four windings on each center roll segment and nine on intermediate roll segment 113B. Once again, the machine reversed helical wrapping direction towards end roll segment 111A, wrapping four layers on each center roll segment, four on intermediate roll segment 113A, and starting the new cycle with 32 on end roll segment 111A.

The roll package resulting from the wind sequence provided improved end roll segment stability as compared with earlier roll package methods winding twice the windings on roll end segments as compared with all or, substantially all, of the inner segments. The roll package allowed larger wrapped diameter, increased capacity, and improved resistance to telescoping and roll damage as compared with previous methods.

Accordingly the reader will see that the MULTI-ROLL SEGMENT PACKAGE FOR PLASTIC TAPE disclosed and claimed provides an improved roll package for plastic tape. The roll package provides the following additional advantages:

- The roll package density is high, increasing the length of tape on a given size roll package, reducing converting roll change time and shipping costs;
- The roll package is stable, reducing roll package damage and waste;
- Larger package diameters may be wound, reducing converting equipment change time and shipping costs; and
- The roll package is simple to make and use.

Although the description above contains many specifications, these should not be construed as limiting the scope of the invention but as merely providing illustrations of some of the presently preferred embodiments of this invention. For example, in some embodiments, all of the spiral winding groups meet the relative winding number specifications in this disclosure. In other embodiments, the majority, or at least a substantial number of, the spiral winding groups meet the relative winding number specifications. Deviation of the relative group winding numbers or frequency of visits for a portion of the total roll segment wind does not depart from the spirit of the invention, that is to reduce the number of visits and increase the number of windings in the end spiral groups of the end roll segments as compared to the intermediate and center roll segments of prior art rolls. In other embodiments, one or more helically-wound "wrapping layers" are wound over the roll segments to provide a protection and a stabilizing cover for the roll package.

Thus the scope of the invention should be determined by the appended claims and their legal equivalents, rather than by the examples given.

I claim:

1. A multi-segment roll package for storing and dispensing plastic tape, the package comprising:

a plurality of roll segments wrapped on a core and built up from a continuous length of the plastic tape, each of said plurality of roll segments comprising a plurality of concentrically disposed spiral winding groups, said spiral winding groups comprising a plurality of continuous tape windings interrupted by helically wrapped portions of tape traversing to an adjacent roll segment, the plurality of roll segments further comprising;

at least one center roll segment comprising a plurality of center spiral groups, at least two intermediate roll segments comprising a plurality of intermediate spiral groups, and two end roll segments comprising a plurality of end spiral groups;

wherein said end spiral groups comprise a greater number of tape windings than said intermediate spiral groups and at least a portion of said intermediate spiral groups comprise a greater number of tape windings than said center spiral groups.

2. The roll package of claim 1 wherein said at least a portion of intermediate spiral groups comprise at least twice the number of tape windings than said center spiral groups.

3. The roll package of claim 1 wherein said end spiral groups comprise at least twice the number of tape windings than said intermediate spiral groups.

4. The roll package of claim 1 wherein said end spiral groups comprise at least three times the number of tape windings than said center spiral groups.

5. The roll package of claim 1 wherein said end spiral groups comprise at least four times the number of tape windings than said center spiral groups.

6. A multi-segment roll package for storing and dispensing plastic tape, the package comprising:

a plurality of roll segments wrapped on a core and built up from a continuous length of the plastic tape, each of said plurality of roll segments comprising a plurality of concentrically disposed spiral winding groups, said spiral winding groups comprising a plurality of continuous tape windings interrupted by helically wrapped portions of tape traversing to an adjacent roll segment, the plurality of roll segments further comprising;

at least one inner roll segment comprising a plurality of inner spiral groups, and two end roll segments comprising a plurality of end spiral groups;

wherein a substantial number of said end spiral groups comprise greater than 2.5 times the number of tape windings than a substantial number of said inner spiral groups.

7. The roll package of claim 6 wherein said substantial number of said end spiral groups comprise greater than three times the number of tape windings than said substantial number of said inner spiral groups.

8. The roll package of claim 6 wherein said substantial number of said end spiral groups comprise greater than four times the number of tape windings than said substantial number of said inner spiral groups.

9. The roll package of claim 6 wherein said at least one inner roll segment comprises two intermediate roll segments comprising a plurality of intermediate spiral groups, and at least one center roll segment comprising a plurality of center spiral groups, and wherein said substantial number of said end spiral groups comprise greater than 2.5 times the number of tape windings than a substantial number of said center spiral groups.

10. The roll package of claim 6 wherein said at least one inner roll segment comprises at least two intermediate roll segments comprising a plurality of intermediate spiral groups, and at least one center roll segment comprising a plurality of center spiral groups, and wherein said substantial number of said end spiral groups comprise greater than four times the number of tape windings than a substantial number of said center spiral groups.

11. A process for wrapping a length of plastic tape to form a multi-segment roll package, the process comprising the steps:

positioning an end of the plastic tape on a core;

wrapping an end spiral winding group comprising a first plurality of spiral windings about a core axis;

traversing the tape in a first axial direction while winding the roll package;

wrapping an intermediate spiral winding group comprising a second plurality of spiral windings about the core axis;

traversing the tape in the first axial direction while winding the roll package; and wrapping a center spiral winding group comprising a third plurality of spiral windings about the core axis;

wherein the first plurality of spiral windings is at least 2.5 times the third plurality of spiral windings.

12. The process of claim 11 wherein the first plurality of spiral windings is at least four times the third plurality of spiral windings.

13. The process of claim 11 wherein the first plurality of spiral windings is greater than the second plurality of spiral windings and the second plurality of spiral windings is greater than the third plurality of spiral windings.

* * * * *